US009090951B2

(12) United States Patent
Brandstätter et al.

(10) Patent No.: US 9,090,951 B2
(45) Date of Patent: Jul. 28, 2015

(54) METHOD FOR PRODUCING COATED AND HARDENED COMPONENTS OF STEEL AND COATED AND HARDENED STEEL STRIP THEREFOR

(75) Inventors: Werner Brandstätter, Sankt Andrä (AT); Siegfried Kolnberger, Pasching (AT); Thomas Kurz, Linz (AT); Martin Peruzzi, Linz (AT); Johann Strutzenberger, Kirchdorf (AT); Thomas Manzenreiter, Linz (AT)

(73) Assignee: VOESTALPINE STAHL GMBH, Linz (AT)

( * ) Notice: Subject to any disclaimer, the term of this patent is extended or adjusted under 35 U.S.C. 154(b) by 1409 days.

(21) Appl. No.: 12/809,186

(22) PCT Filed: Dec. 18, 2008

(86) PCT No.: PCT/EP2008/010850

§ 371 (c)(1),
(2), (4) Date: Dec. 1, 2010

(87) PCT Pub. No.: WO2009/080292

PCT Pub. Date: Jul. 2, 2009

(65) Prior Publication Data

US 2011/0076477 A1 Mar. 31, 2011

(30) Foreign Application Priority Data

Dec. 20, 2007 (DE) ..... 10 2007 061 489

(51) Int. Cl.
*C21D 1/68* (2006.01)
*C23C 2/02* (2006.01)

(Continued)

(52) U.S. Cl.
CPC ..... *C21D 1/68* (2013.01); *C21D 8/0278* (2013.01); *C21D 8/0478* (2013.01); *C21D 9/48* (2013.01);

(Continued)

(58) Field of Classification Search
CPC ..... C21D 4/68; C21D 4/70; C21D 4/71; C21D 9/46; C21D 9/48; C21D 8/0478; C23C 2/02; C23C 2/06; C23C 2/12; C23C 2/28; C23C 28/00; B32B 7/02; B32B 15/04
See application file for complete search history.

(56) References Cited

U.S. PATENT DOCUMENTS 6,087,019 A * 7/2000 Isobe et al. ..... 428/472
2003/0047255 A1 3/2003 Delaunay et al.
2008/0283157 A1 11/2008 Katsube et al.

FOREIGN PATENT DOCUMENTS

DE 000002452486 C2 5/1975
DE 000004290508 T1 3/2005

(Continued)

OTHER PUBLICATIONS

International Preliminary Report on Patentability in the European Patent Office, dated Apr. 8, 2010.

*Primary Examiner* — Lois Zheng

(57) ABSTRACT

The invention relates to a method for the production of a hardened component made of a hardenable steel, wherein the steel strip is exposed to a temperature increase in an oven, and is thus exposed to an oxidizing treatment such that a surface oxide layer is created, and subsequently a coating using a metal or a metal alloy is carried out. The strip is heated and at least partially austenitized for producing an at least partially hardened component, and subsequently cooled and thereby hardened. The invention also relates to a steel strip produced according to said method.

9 Claims, 5 Drawing Sheets

(51) Int. Cl.

| | |
|---|---|
| ***C21D 8/02*** | (2006.01) |
| ***C21D 8/04*** | (2006.01) |
| ***C21D 9/48*** | (2006.01) |
| ***C23C 2/06*** | (2006.01) |
| ***C23C 2/12*** | (2006.01) |
| ***C23C 2/28*** | (2006.01) |
| *C21D 1/673* | (2006.01) |
| *C21D 9/46* | (2006.01) |

(52) U.S. Cl.
CPC ... *C23C 2/02* (2013.01); *C23C 2/06* (2013.01); *C23C 2/12* (2013.01); *C23C 2/28* (2013.01); *C21D 1/673* (2013.01); *C21D 9/46* (2013.01); *Y10T 428/24983* (2015.01)

(56) References Cited

FOREIGN PATENT DOCUMENTS

| | | | | | |
|---|---|---|---|---|---|
| DE | 102004059566 | B3 | | 8/2006 | |
| EP | 000000947606 | A1 | | 10/1999 | |
| EP | 000000971044 | A1 | | 1/2000 | |
| EP | 000001143029 | A1 | | 10/2001 | |
| EP | 000001285972 | A1 | | 2/2003 | |
| EP | 000001504134 | B1 | | 5/2007 | |
| EP | 000001826289 | A1 | | 8/2007 | |
| EP | 000001829983 | A1 | | 9/2007 | |
| JP | 624860 | A | | 1/1987 | |
| JP | 01-159318 | | * | 6/1989 | ..... C21D 8/02 |
| JP | 2003193213 | A | | 7/2003 | |
| JP | 2007291498 | A | | 11/2007 | |
| WO | 2005021821 | A1 | | 3/2005 | |
| WO | 2006106999 | A1 | | 10/2006 | |
| WO | 2008138412 | A1 | | 11/2008 | |

* cited by examiner

METHOD FOR PRODUCING COATED AND HARDENED COMPONENTS OF STEEL AND COATED AND HARDENED STEEL STRIP THEREFOR

FIELD OF THE INVENTION

The invention relates to a method for producing hardened components from hardenable steel and a hardenable steel strip therefor.

BACKGROUND OF THE INVENTION

Producing components from a hardenable steel, in particular hardened components, is known. Hereinafter, hardenable steel is to be understood to be steel in which a phase transition of the basic material occurs during heating, and in which a material, which is significantly harder or has higher tensile strengths than the starting material, results in a subsequent cooling, the so-called quench hardening, from the previous structural transformation and, optionally, further structural transformations during quench hardening.

For example, the method of the so-called press hardening is known from DE 24 52 486 C2, in which a plate of a hardenable steel material is heated to above the so-called austenitizing temperature and, in the heated state, is inserted into a forming tool and formed and simultaneously cooled in this forming tool, which on the one hand results in the final geometry of the desired component, and, on the other hand, in the desired hardness or strength. This method is widely used.

A method in which a hardened component is produced from hardenable steel sheet with a cathodic corrosion protection, in which the component is cold formed already in a metal-coated state so that it is 0.5% to 2% smaller than the nominal final dimension of the finished hardened component, is known from EP 1 651 789 A1. The component is then heated and inserted into a tool which corresponds exactly to the final dimensions of the desired component. The coated component has expanded to exactly this final dimension by thermal expansion, and is held on all sides and cooled in the so-called forming tool, which causes hardening to occur.

Moreover, a method is known from EP-A 0 971 044 in which a metal sheet from a hardenable steel and with a metallic coating is heated to a temperature above the austenitizing temperature and is then transferred into a hot-forming tool, where the heated metal sheet is formed and simultaneously cooled and hardened by the cooling process.

It is a drawback of the aforementioned methods for hot forming that—independent from whether or not there is a metallic coating on the steel substrate—micro-cracks occur in the steel substrate, in particular during hot-forming, but also in cold-preformed components, in which the forming process has not been completed.

These micro-cracks occur, in particular, in areas that are being formed, and in particular in areas with high degrees of forming. These micro-cracks are located on the surface and/or in the metallic coating and may partially extend relatively far into the basic material. In this case, it is disadvantageous that such cracks continue to grow if the component is subjected to stress, and that they constitute damage to the component that can lead to failure in the case of stress.

Metallic coatings on steel have long been known in the form of aluminum, aluminum alloy coatings, in particular aluminum-zinc alloy coatings, zinc coatings and zinc alloy coatings.

Such coatings have the purpose of protecting the steel material against corrosion. In the case of aluminum coatings, this is effected by means of a so-called barrier protection, in which the aluminum creates a barrier against the admission of corrosive media.

In the case of zinc coatings, protection is effected by means of the so-called cathodic effect of the zinc.

So far, such coatings have been used in particular in the case of normal-strength steel alloys, in particular for motor vehicle construction, building industry, but also in the household appliance industry.

They can be applied onto the steel material by hot-dip coating, PCD or CVD methods or by electrodeposition.

By using higher-strength steel qualities, an attempt was also made to coat the latter with such hot-dip coats.

From DE 10 2004 059 566 B3, for example, a method for hot-dip coating a strip of higher-strength steel is known in which the strip is first heated to a temperature of approximately 650° C. in a continuous furnace in a reducing atmosphere. At this temperature, the alloy constituents of the higher-strength steel are supposed to diffuse to the surface of the strip in only small quantities. The surface, which in this case consists primarily of pure iron, is converted into an iron oxide layer by a very short heat treatment at a higher temperature of up to 750° C. in a reduction chamber integrated into the continuous furnace. This iron oxide layer is supposed to prevent the diffusion of the alloy constituents to the surface of the strip in a subsequent annealing process at a higher temperature in a reducing atmosphere. In the reducing atmosphere, the iron oxide layer is converted into a purer iron layer onto which zinc and/or aluminum is applied in the hot-dip bath so as to adhere optimally. The oxide layer applied by means of this method is supposed to have a thickness of maximally 300 nm. In practice, the layer thickness is mostly set to approximately 150 nm.

It is the object of the invention to provide a method for producing hardened components from hardenable steel with which the forming behavior, in particular also the hot-forming behavior, is improved.

It is a further object to provide a steel strip which has an improved formability, in particular hot-formability.

SUMMARY OF THE INVENTION

The invention provides to superficially oxidize a hot or cold-rolled steel strip, to then carry out a metallic coating and, if necessary, to cut a plate from a correspondingly coated metal sheet for the purpose of producing the component, to heat the plate in order to at least partially austenitize it by heating in such a way that an at least partially hardened structure or partially hardened component is formed during a subsequent forming and cooling of the plate. Surprisingly, a ductile layer is superficially formed from the hardenable steel by the superficial oxidation of the strip, apparently during the heating for the purpose of austenitizing and/or during forming and cooling, the layer being capable of dissipating tensions during forming so well that no micro-cracks form anymore. In the process, the metallic coating serves to protect against superficial decarburization, with this metallic coating of course being able also to take on other tasks, such as corrosion protection.

A protective gas atmosphere can also be produced during heating, instead of a metallic coating, for the purpose of austenitization; in particular, a superficial oxidation, e.g. up to about 700° C. in an oxidizing atmosphere, can be brought about, and the further heating can be carried out under an inert gas atmosphere in such a way that further oxidation and/or decarburization does not happen.

If necessary, the oxidation of the steel strip for the purpose of applying the metallic coating can be superficially reduced in order to achieve a reactive surface.

However, the oxide layer is in no case removed to a large extent for the purpose of galvanizing as is the case in conventional pre-oxidation. Moreover, the oxidation according to the invention is carried out in a far greater extent than the pre-oxidation according to the prior art. Pre-oxidation according to the prior art takes place up to a thickness of maximally 300 nm, the oxidation according to the invention in a far greater extent, so that even after a reduction has been carried out, there still remains an oxidized layer of preferably at least 300 nm thickness.

Apparently, an iron oxide layer, which of course also contains oxides of the alloy elements, is created not only superficially by the oxidation according to the invention, but it appears that the alloy elements are partially oxidized also beneath this layer.

After hardening, a component produced according to the inventive method exhibits on the surface a thin layer between the steel substrate and the coating, which in the microsection in FIG. 4 appears as a whitish layer. The currently most probable cause for this ductile layer is oxidized alloy elements which were not available for the phase transition in the superficially oxidized area during hardening, or which delayed or impeded this transition. However, the exact mechanisms could not be explained so far.

Surprisingly, it was found that such an oxidation, which is not necessary for the actual coating with a coating metal, leads to an enhanced ductility of the hardened substrate in the surface area also after metal coating. Surprisingly, using an oxidation forming an iron oxide layer with a layer thickness>300 nm, a metal sheet can be obtained which can be formed free from micro-cracks, also in the case of hot forming and during the heat treatment for the purpose of hardening, for example for a suitable steel of the type 22MnB5 above 850° C. or the respective austenitizing temperature.

The invention is explained by way of example with reference to the drawings.

DETAILED DESCRIPTION OF THE PREFERRED EMBODIMENTS

Figure 1:
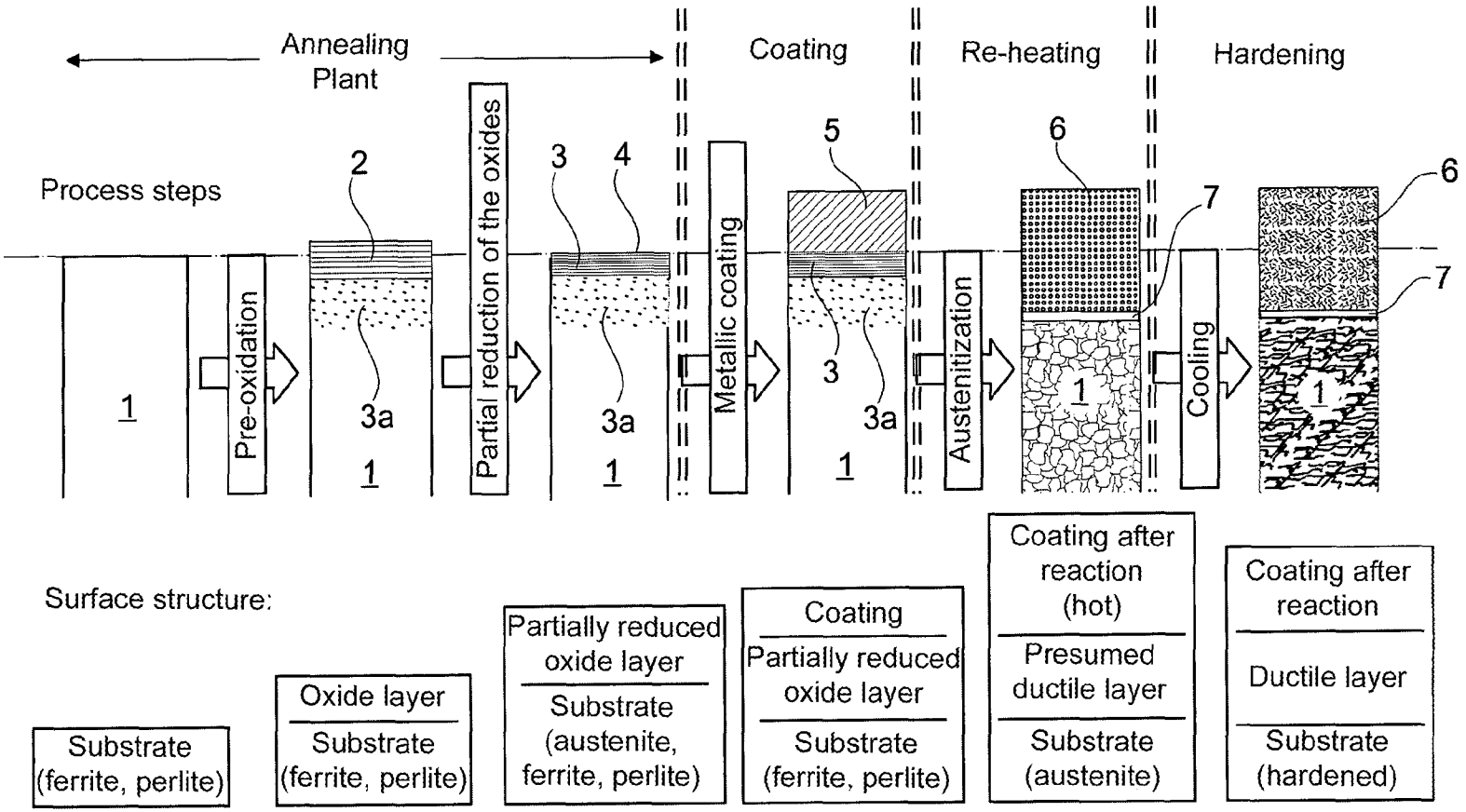
FIG. 1 shows the process flow according to the invention in a very schematic view.

In FIG. 1, the method according to the invention is illustrated by way of a process flow, for example for a hot-dip coated steel strip, in particular a galvanized steel strip of the type 22MnB5 with a Z140-coating.

Figure 3:
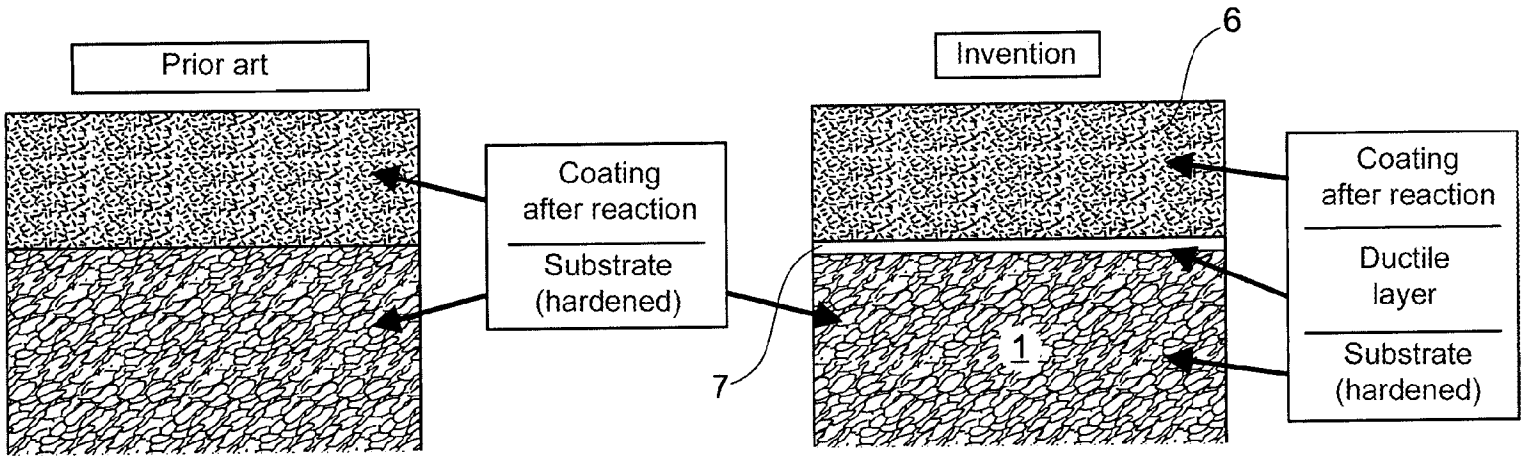
FIG. 3 shows, in a very schematic manner, a layer structure according to the invention as compared with the prior art after hardening.

The layer thicknesses shown in FIGS. 1 and 3 are not shown to scale, but are distorted in scale relative to each other for better representation.

A bright steel strip 1 is subjected to oxidation prior to hot-dip coating, so that the strip 1 is provided with an oxide layer 2.

This oxidation is carried out at temperatures of between 650° and 800° C. Whereas the oxide layer thickness would be completely sufficient at 150 nm for a conventional pre-oxidation that would be required for a hot-dip galvanization, oxidation according to the invention is carried out such that the oxide layer thickness is >300 nm. In order to apply the metallic hot-dip coating, e.g. hot-dip galvanization or aluminization, a partial reduction of the oxides at the surface is carried out in the next step, so that a very thin reduced layer 4 is produced which substantially consists of pure iron. A residual oxide layer 3 remains beneath it.

Because of the oxidation, there probably remains an area of "inner oxidation" 3*a* underneath the oxide layer 3. In this area 3*a*, the alloy elements are apparently partially oxidized or are partially present in an oxidized form.

Hot-dip coating with a coating metal is then carried out, so that a layer 5 from the coating metal results on the residual oxide layer 3. In order to now obtain the hardened component, the strip 1 is heated to the austenitizing temperature and is at least partially austenitized, whereby the metallic coating 5 and the surface of the strip 1 alloy with each other, among other things. In the process, the oxide layer 3 is partially or completely consumed, or cannot be detected during the high-temperature treatment, due to diffusion processes between the strip 1 and the metallic coating 5.

In the case of a metallic coating applied by galvanization, the deposition on the oxide layer can be carried out without prior reduction, or with a reduction, optionally, however, an etching process is also carried out.

In order to obtain the hardened or partially hardened component, depending on the degree of austenitization, forming and cooling then takes place in a tool, wherein the layer 6 optionally transitions with regard to the phases, and wherein a phase transition also takes place in the strip 1. After hardening, a light, ductile layer 7 can be observed in the microsection (FIG. 4) between the strip 1 and the metallic coating 6, which apparently is responsible for the final product to be a hardened component free from micro-cracks. This ductile layer 7 probably already forms during heating for the purpose of hardening and is thus already in existence during hot forming.

Apparently, the most probable cause for this light layer 7 is that, due to the oxidation which has been carried out, the alloy elements required for hardening, such as manganese, were oxidized in the area close to the surface prior to the metallic coating and are not available for a transition or impede a transition, so that the steel strip forms this ductile layer 7 in the very thin area close to the surface, which is apparently sufficient to compensate the tensions close to the surface in such a way that no cracks form during forming and that the cracks do not propagate.

It is also assumed that the area 3*a* of the "inner oxidation" of the alloy elements is of importance in this regard.

The advantage of the method also shows after hardening, or can be detected after hardening, when a metal sheet produced or hardened according to the invention is subjected to a three-point bending test, for example. This can also have a positive influence on the crash behavior.

In this three-point bending test, two bearings with a diameter of 30 mm are disposed at a distance of twice the sheet thickness. The hardened sheet is placed thereon and then subjected to stress with a bending rail having a radius of 0.2 mm at the same distance, respectively, from the bearings.

The time, the distance from the contact of the bending rail with the sample, and the force are measured.

Force and distance, or a force-bending angle curve are recorded, with the angle being calculated from the distance. The test criterion is the bending angle at maximum force.

Figure 2:
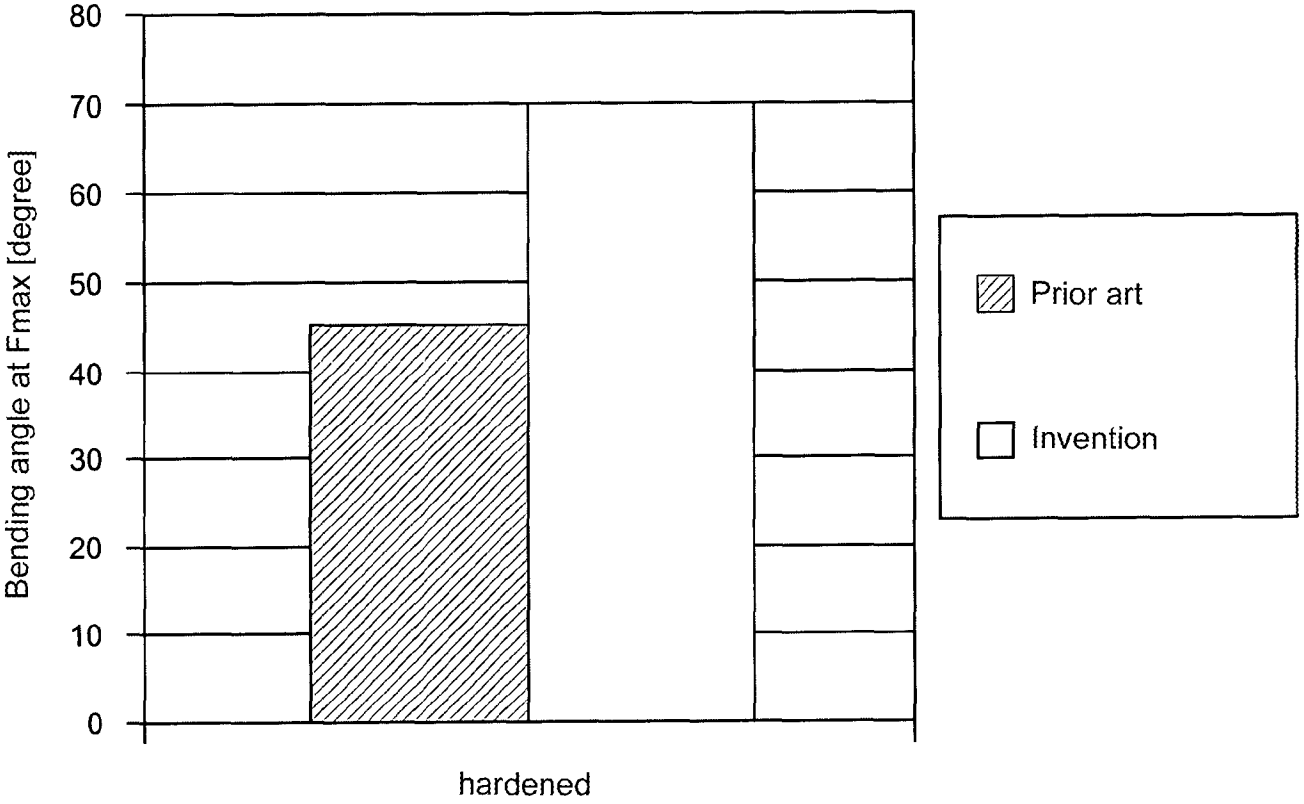
FIG. 2 shows a diagram which shows the improvement of the bending angle in the invention as compared with the prior art.

The comparison can be seen in FIG. 2 for a steel of the type 22MnB5 with a coating Z140, from which it is evident that a considerably larger bending angle can be obtained by the ductile layer generated according to the invention in the hardened cold sample.

The invention and the prior art are compared once again also in FIG. 3, according to which there is a metallic coating after hardening in the prior art which adheres to the hardened substrate, but in which there is no ductile layer.

In the invention, the ductile layer 7 is located between the hardened substrate and the coating after the hardening reaction.

The mean layer thickness of this layer is greater than 0.3 μm, wherein the layer can be continuous, but does not have to be completely continuous in order to cause the success according to the invention.

Figure 6:
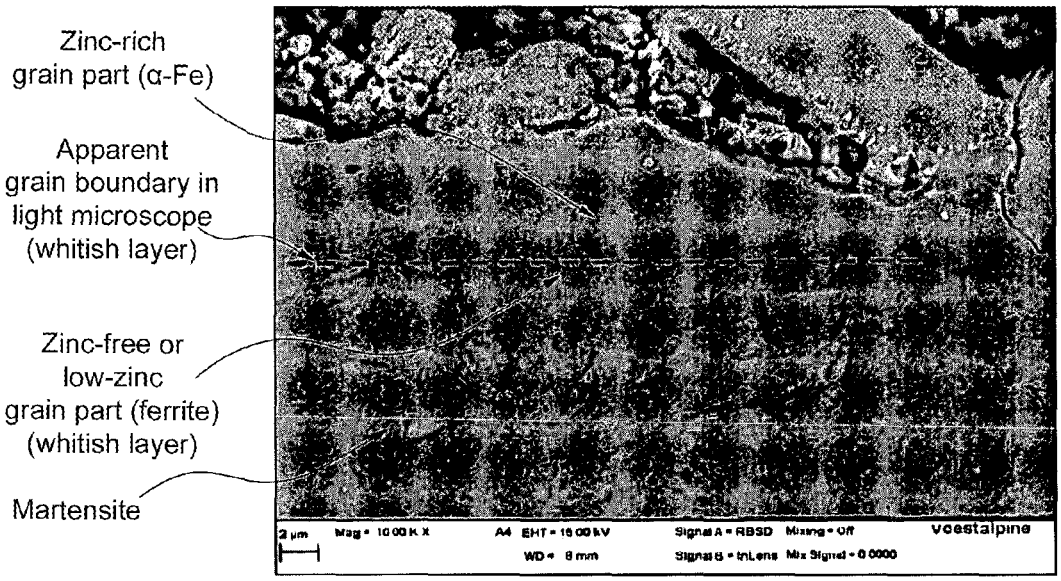
FIG. 6 shows a scanning electron-microscopic microsection image of a comparative example according to the invention.

FIG. 6 shows a scanning electron-microscopic microsection image of a comparative example according to the invention. It can be seen that the zinc content drops abruptly from a Zn content of approx. 40% to less than 5% Zn, due to the diffusion processes in the direction of the basic material martensite.

Close to the basic material, the grains of the iron-zinc layer only have a very low zinc content; this Fe-rich layer, which in the microsection shows up with a whitish color, acts as a ductile intermediate layer between the other layer bodies.

Figure 7:
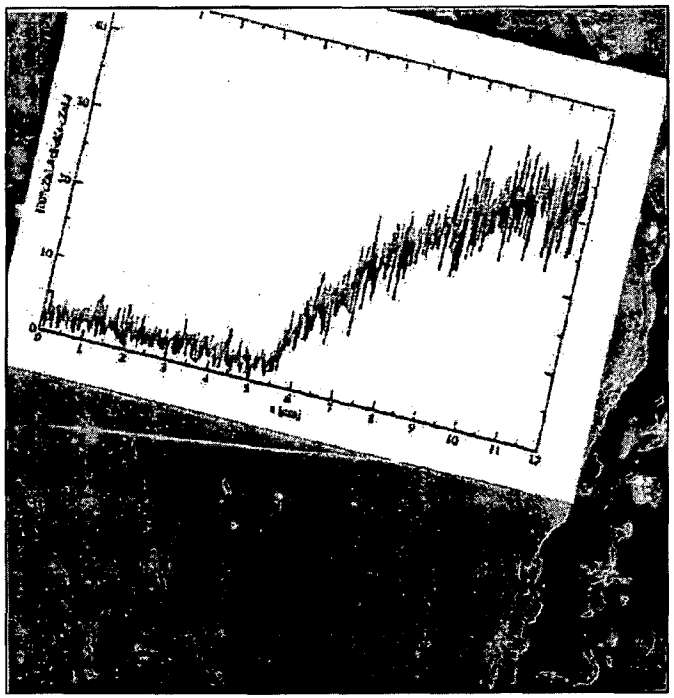
FIG. 7 shows a detail from the scanning electron-microscopic microsection image of FIG. 6 with a line-zinc concentration profile from an energy dispersive X-ray analysis (EDX).

FIG. 7 shows a detail from FIG. 6 with a line-zinc concentration profile from an energy dispersive X-ray analysis (EDX). Once again, it becomes clear that the zinc content drops in the direction of the basic material.

Figure 4:
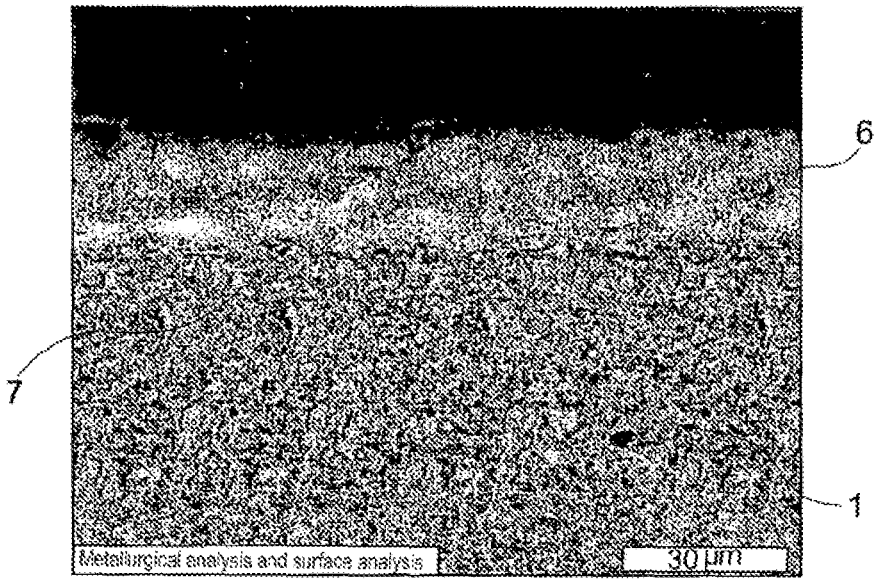
FIG. 4 shows a microscopic microsection image of the surface of the steel strip according to the invention.
Figure 5:
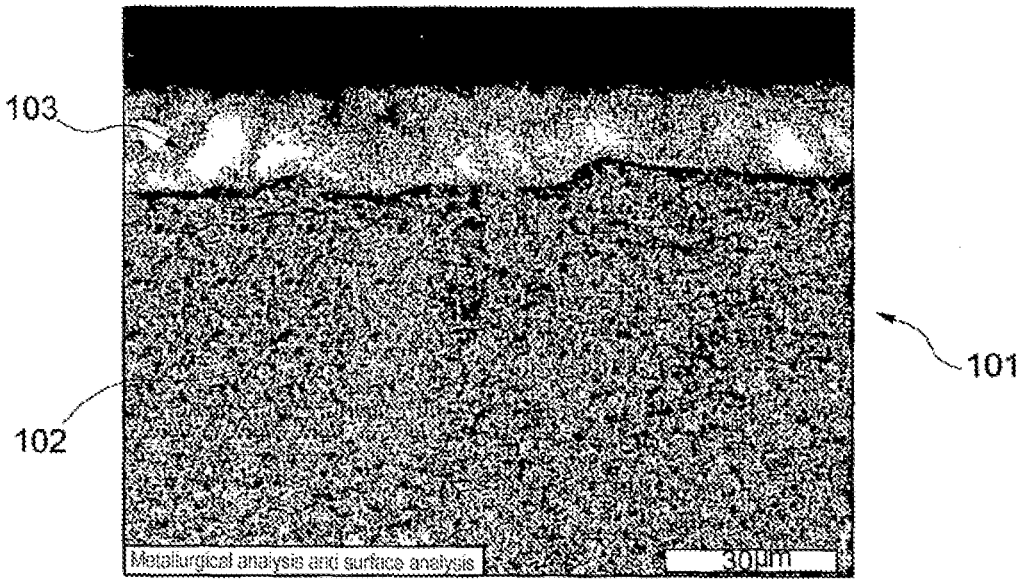
Fig. 5 (Prior Art)
FIG. 5 shows a microscopic microsection image of a comparative example that is not in accordance with the invention.

FIGS. 4 and 5 each show a microsection image of a hardened steel strip of the invention (FIG. 4) and the prior art (FIG. 5), with the substrate 1, the overlying transitioned metallic layer 6 and, between them, the ductile layer 7 being clearly visible in the microsection.

FIG. 5 shows a layer structure according to the prior art in which a galvanized strip 101 has a steel substrate 102 of higher-strength steel, onto which a zinc-iron layer 103 has been applied. There is no ductile layer.

According to the invention, the metallic coating can be selected from all usual metallic coatings since the point is merely to counteract any decarburization. Thus, the coatings may be pure aluminum or aluminum-silicon coatings as well as alloy coatings from aluminum and zinc (Galvalume) and coatings of zinc or substantially zinc. However, other coatings from metals or alloys are also suitable if they are able to withstand the high temperatures during hardening for a short term.

The coatings can be applied, for example, by galvanization or hot-dip coating, or by PVD or CVD methods.

In this case, oxidation can be caused in a classical manner by passing the strip through a directly heated preheater in which gas burners are used and in which an increase of the oxidation potential in the atmosphere surrounding the strip can be produced by changing the gas-air mixture. The oxygen potential can thus be controlled and cause an oxidation of the iron on the surface of the strip. In this case, control is carried out such that an oxidation is achieved which is considerably greater than the oxidation of the prior art. In a subsequent furnace line, the iron oxide layer formed, or an inner oxidation of the steel which has possibly been achieved, is reduced only superficially or partially, in contrast to the prior art.

Moreover, it is possible to anneal the strip in an RTF preheater known per se under a protective gas atmosphere, with oxidation or pre-oxidation also being carried out in considerably greater degree than would actually be required. The strength of oxidation can in this case be adjusted in particular by the supply of an oxidizing agent.

Moreover, it was shown that a humidification of the furnace atmosphere, i.e. an atmosphere that is very rich in water vapor (richer than usual), alone or together with other oxidizing agents, achieves the desired effect. What is essential in the invention is that the reduction that optionally follows is only carried out such that a residual oxidation remains. The inner oxidation state of the steel is not reverted completely in a heat treatment with only a water vapor-containing atmosphere.

The oxidation can be controlled via the atmosphere, the concentration of the oxidizing agent of an optionally added further oxidizing agent, the duration of the treatment, the temperature curve and the content of water vapor in the furnace chamber.

A strip thus treated, as it is shown in FIGS. 3 and 4, can be cold-formed, heated and press-hardened or post-formed, but also hot-formed and press-hardened, in an excellent manner and free from micro-cracks in the steel substrate.

In this case, it was shown that carrying out the oxidation in accordance with the invention—in contrast to the edge-decarburization in uncoated steel material—has no negative effects on the final strength of the material that can be achieved.

It is an advantage of the invention that a method and a steel strip are created which make it possible in a simpler and safe manner to considerably improve upon the quality of formed and hardened components.

The invention claimed is:

1. A method for producing a hardened component from a hardenable steel, comprising:

subjecting a steel strip of a type 22MnB5 to a temperature increase and, in the process, an oxidizing treatment in a furnace chamber, so that a superficial oxide layer is produced;

after the superficial oxide layer has been produced, coating the steel strip with a metal or a metal, alloy, and, in order to produce an at least partially hardened component, heating the strip and at least partially austenitizing the strip and then cooling off and thus hardening the strip; and in order to produce a superficial ductile layer, partially reducing oxides at the surface of the strip prior to coating the strip with a metal or a metal alloy, thus producing a very thin reduced layer located on a residual oxide layer;

wherein an area of an inner oxidation is located beneath the residual oxide layer in the strip, in which steel-alloy elements are present in a partially oxidized form.

2. The method according to claim 1, further comprising:

carrying out a reducing treatment after producing the superficial oxide layer in order to reverse the oxidation superficially; and subsequently coating the steel strip with the metal or the metal alloy, wherein the oxidation and the reduction are carried out such that, after the superficial reduction and the coating, an oxide layer remains between the coating and the steel strip.

3. The method according to claim 1, wherein the coating of the steel strip with a metal or metal alloy is carried out by hot-dip coating with a molten metal or a molten metal alloy or by electrodeposition of one or more metals on the strip or by PVD and/or CVD methods.

4. The method according to claim 1, wherein the oxidizing treatment is carried out using an oxidizing furnace chamber atmosphere and/or a water-vapor containing furnace chamber atmosphere.

5. The method according to claim 4, wherein the degree of oxidation from the oxidation treatment and the thickness of the superficial oxide layer are adjusted by the content of oxidizing agents in the treatment atmosphere and/or the duration of the treatment and/or the temperature level and/or the water-vapor concentration in the furnace chamber.

6. The method according to claim 1, wherein the coating of the steel strip with a metal or metal alloy is carried out with aluminum or an alloy substantially containing aluminum, or with an alloy from aluminum and zinc, and/or a different zinc alloy substantially containing zinc and/or zinc and or other coating metals.

7. The method according to claim 2, wherein the furnace chamber in which the oxidation and/or reduction is carried out is directly or indirectly heated.

8. The method according to claim 2, wherein the furnace chamber in which the oxidation and/or reduction is carried out is heated by means of gas and/or oil burners and/or convectively, or the steel strip is heated inductively.

9. The method according to claim 2, wherein the oxidation is carried out such that an oxidation layer thickness of more than 300 nm is achieved at the end of the oxidation, and the subsequent reduction is carried out such that the oxide layer is partially reduced from the surface.

* * * * *